United States Patent [19]

Takano

[11] 4,292,386

[45] Sep. 29, 1981

[54] PHOTOCONDUCTIVE DRUM WITH PAPER LAYER ATTACHMENT

[75] Inventor: Toshimasa Takano, Sagamihara, Japan

[73] Assignee: Tokyo Shibaura Denki Kabushiki Kaisha, Kawasaki, Japan

[21] Appl. No.: 104,061

[22] Filed: Dec. 17, 1979

[30] Foreign Application Priority Data

Dec. 22, 1978 [JP] Japan ..... 53-158828
Dec. 22, 1978 [JP] Japan ..... 53-176360[U]
Dec. 27, 1978 [JP] Japan ..... 53-180564[U]

[51] Int. Cl.[3] ..... G03G 5/14

[52] U.S. Cl. ..... 430/63; 430/56; 430/60; 430/127; 355/3 DR; 229/4.5; 229/48 T; 229/48 SA

[58] Field of Search ..... 430/56, 60, 63, 64, 430/132, 133, 134, 127; 355/3 DR; 229/4.5, 48 R, 48 T, 48 SA; 93/1.1, 94 R

[56] References Cited

U.S. PATENT DOCUMENTS

| | | | |
|---|---|---|---|
| 477,593 | 6/1892 | Greenfield | 93/94 R |
| 1,202,858 | 10/1916 | Lachman | 229/48 R X |
| 1,297,994 | 3/1919 | Boyer | 229/48 R |
| 1,885,587 | 11/1932 | Burton | 229/4.5 X |
| 2,048,895 | 7/1936 | Rosen | 93/1.1 X |
| 3,157,337 | 11/1964 | Elam | 229/4.5 |
| 3,411,542 | 11/1968 | Walsh et al. | 229/4.5 X |
| 3,661,322 | 5/1972 | Norman | 229/4.5 X |
| 3,783,021 | 1/1974 | York | 430/56 X |
| 3,819,370 | 6/1974 | Komiya et al. | 430/132 X |

FOREIGN PATENT DOCUMENTS

| | | | |
|---|---|---|---|
| 2330500 | 1/1975 | Fed. Rep. of Germany | 229/48 T |
| 2821745 | 11/1978 | Fed. Rep. of Germany | 355/3 DR |
| 51-99527 | 9/1976 | Japan | 430/60 |
| 912837 | 12/1962 | United Kingdom | 430/63 |

*Primary Examiner*—Roland E. Martin, Jr.
*Attorney, Agent, or Firm*—Cushman, Darby & Cushman

[57] ABSTRACT

An electronic copying apparatus includes a photosensitive drum having a drum body and a photosensitive layer of (ZnO) formed on the outer periphery of the drum body. Said drum body has a hollow cylinder made of paper or synthetic resin, a conductive layer formed on the outer periphery of said hollow cylinder and a low resistance layer formed on the outer peripheral surface of the conductive layer, said photosensitive layer formed on the outer peripheral surface of said low resistance layer.

2 Claims, 7 Drawing Figures

PHOTOCONDUCTIVE DRUM WITH PAPER LAYER ATTACHMENT

BACKGROUND OF THE INVENTION

This invention relates to an electronic copying apparatus, and more particularly an electronic copying apparatus having a photosensitive drum which has a drum body with a photosensitive layer laid on its pariphery.

The photosensitive drum of a known electronic copying apparatus comprises a drum body with a hollow cylinder and a photosensitive layer laid on the outer periphery of the drum body. The cylinder is made of a metal, usually aluminum, because it must be electrically conductive and strong enough to maintain its circularity. The photosensitive layer is made of selenium (Se) or cadmium sulfide (CdS), either vapor-deposited or coated over the outer periphery of the drum body, and has a uniform thickness.

Made of a metal, the cylinder is heavy. The mechanism supporting the photosensitive drum is inevitably large, and so is the mechanism for driving the drum. This raises the manufacture cost of the copying apparatus. Further, the photosensitive layer wears, and the lifetime of the drum is limited. The drum needs to be replaced by a new one when its photosensitive layer is found no longer effectively functioning. A repairman replaces an old drum with a new one. His work is rather hard and cumbersome since the drum is heavy. The old drum is thrown away. If its cylinder is made of an expensive metal, its running cost will rise.

SUMMARY OF THE INVENTION

An object of this invention is to provide an electronic copying apparatus with a light and inexpensive photosensitive drum which simplifys the mechanism for supporting the drum and allows the mechanism for driving the drum to be made smaller, thereby to reduce the cost of the electronic copying apparatus.

DETAILED DESCRIPTION OF THE PREFERRED EMBODIMENTS

Now referring to the accompanying drawings, an electronic copying apparatus according to this invention will be described.

Figure 1:
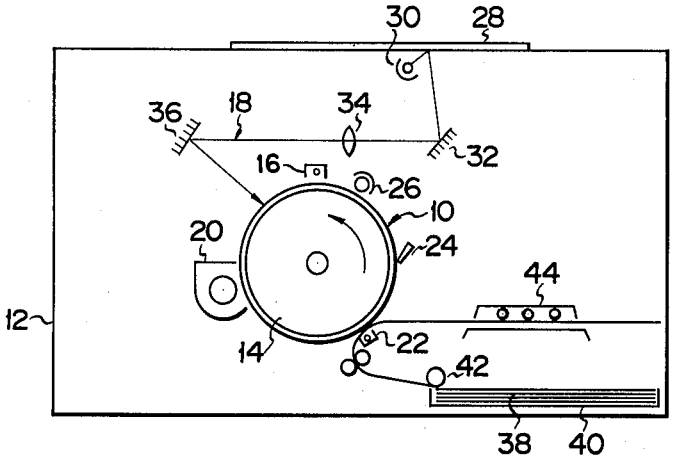
FIG. 1 schematically shows an electronic copying apparatus according to this invention.

As shown in FIG. 1, the apparatus comprises a housing 12 and a photosensitive drum 10 provided in the housing 12. The drum 10 is supported at both ends on a pair of cylinder-supporting members 14 and is rotated in the direction of arrow by a drive mechanism (not shown). Around the drum 10 and in the direction of rotation of the drum 10, there are arranged a charger 16, an exposure device 18, a developing device 20, a transfer device 22, a cleaning device 24 and a lamp 26—all of known types. The exposure device 18 is constituted by an exposure lamp 30, a first mirror 32, a lens 34 and a second mirror 36. The lamp 30 scans an original 28, and the lends 34 and the mirrors 32 and 36 guide the light reflected on the original 28 to the surface of the drum 10. Below the drum 10 a paper cassette 40 is provided, in which sheets 38 of copying paper are piled upon one another. The sheets 38 are fed by a feeding roller 42 into the gap between the transfer device 22 and the surface of the drum 10. A fixing device 44 is disposed above the paper cassette 40 and fixes an image transferred onto each sheet 38.

Figure 2:
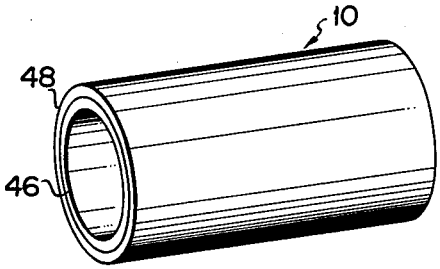
FIG. 2 is a perspective view of a photosensitive drum used in the electronic copying apparatus shown in FIG. 1.
Figure 3:
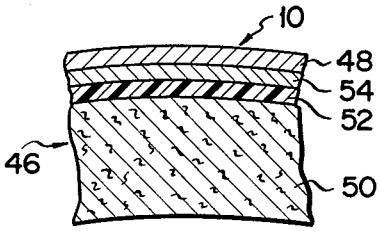
FIG. 3 is a cross sectional view of a part of the photosensitive drum shown in FIG. 2.

As shown in FIG. 2, the photosensitive drum 10 is constituted by a drum body 46 and a photosensitive layer 48 laid on the outer periphery of the drum body 46. As shown in FIG. 3, the drum body 46 is constituted by a hollow cylinder 50, a conductive layer 52 laid on the outer periphery of the cylinder 50 and a low resistance layer 54 laid on the outer peripheral surface of the conductive layer 52. The hollow cylinder 50 is made of paper. The conductive layer 52 is made of a synthetic resin containing carbon powder. The synthetic resin is partly impregnated in the paper cylinder 50. The low resistance layer 54 is made of a low resistant material such as casein and avoids an insulative breakdown of the photosensitive layer 48 under a high voltage. The layer 48 is formed by coating zinc oxide (ZnO) on the outer peripheral surface of the low resistance layer 54.

The cylinder 50 may be made of either new wood pulp or regenerated paper. If made of regenerated paper, it must receive a surface treatment. The cylinder 50 is formed by coiling spirally a thin tape made of new wood pulp or regenerated paper repeatedly until a hollow cylinder having a desired outer diameter and a peripheral wall of a predetermined thickness is obtained. The end portions of the hollow cylinder thus formed are cut so that the cylinder has a predetermined length. It is preferred that the portions of the thin tape which are laid upon one another be glued with a proper adhesive. The cylinder 50 has a layer thickness of about 4 mm to 6 mm, thus being sufficiently strong. An uneven peripheral surface of the paper cylinder 50 thus formed is smoothed, using sand paper.

The photosensitive layer 48 may be made of selenium (Se) or cadmium sulfide (CdS), instead of zinc oxide (ZnO). But zinc oxide is preferred since it can be more readily vapor-deposited on paper than selenium and is less poisonous than cadmium sulfide.

More specifically, the photosensitive layer 48 is formed in the following way. First, a sensitizer such as rose iron oxide is impregnated into zinc oxide. Then, the zinc oxide now impregnated with rose iron oxide is mixed with a binder such as acrylic resin, and copolymer of vinyl chloride and vinyl acetate. The resultant mixture is coated on the outer periphery of the drum body 46.

Now it will be described how the copying apparatus of FIG. 1 is operated.

The photosensitive drum 10 is rotated in the direction of arrow in FIG. 1. As the drum 10 rotates, the photosensitive layer 48 is charged by the charger 16. The exposure lamp 30 of the exposure device 18 is turned on, thus scanning the original 28. The light reflected from the original 28 is guided by the mirror 32, the lens 34 and the mirror 36 and applied onto the outer periphery of the drum 10. As a result, the photosensitive layer 48 now charged is exposed to the light. That portion of the layer 48 which is exposed to the light has its resistance reduced according to the amount of light it receives. An electrostatic latent image corresponding to the original 28 is therefore formed on the photosensitive layer 48. The electrostatic latent image is then developed by the developing device 20, and the image thus developed is transferred by the transfer device 22 onto a sheet 38. The image now transferred on the sheet 38 is then fixed by the fixing device 44.

When the photosensitive layer 48 of the drum 10 wears so much that it is no longer useful, the photosensitive drum 10 is detached from the cylinder-supporting members 14. And a new photosensitive drum is attached to the cylinder-supporting members 14. Made mainly of paper, the cylinder 50 of the drum 10 detached from the members 14 may be reduced to ashes. Made of zinc oxide, the photosensitive layer 48 can be discarded without polluting air or water.

Figure 4:
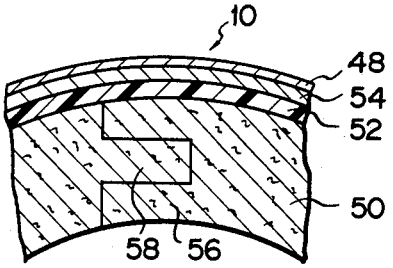
FIGS. 4 to 7 are cross sectional views showing respectively parts of different photosensitive drums according to this invention.
Figure 5:
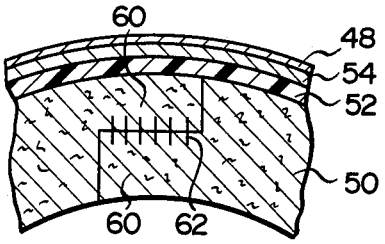
Figure 6:
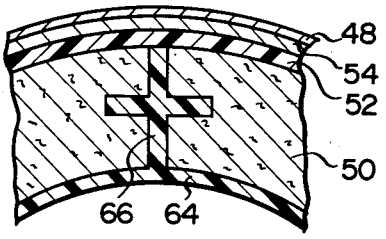

The cylinder 50 shown in FIG. 3 is formed by coiling a thin paper tape repeatedly. Instead, the cylinder 50 may be formed by rolling a thick rectangular paper sheet as shown in FIGS. 4, 5 and 6. The abutting edges of the rolled thick paper sheet may have a convex 56 and a concave 58 and be put together in match joint, bonded together with an adhesive, as illustrated in FIG. 4. Alternatively, as shown in FIG. 5, they may have mating step portions 60 which are fastened to each other with a plurality of staples 62. Or, as shown in FIG. 6, use may be made of a thin hollow cylinder base 64 made of plastics and having on its outer periphery a projection 66 which has a cross-shaped section and which extends parallel to the axis of the cylinder base 64. In this case, the abutting edges of the rolled thick paper sheet are fastened by means of the projection 66. If formed of one thick paper sheet in this manner, the cylinder 50 can be more easily made than it is formed by repeatedly coiling a thin paper tape, because only the abutting edges of the thick paper sheet are glued or fastened to each other and because the entire outer periphery of the cylinder need not be smoothed.

The material of the cylinder 50 is not limited to paper. The cylinder 50 may be made of a synthetic resin. It it is made of a synthetic resin, the cylinder 50 may be formed either by an integral moulding or by repeatedly coiling a thin synthetic resin tape.

Figure 7:
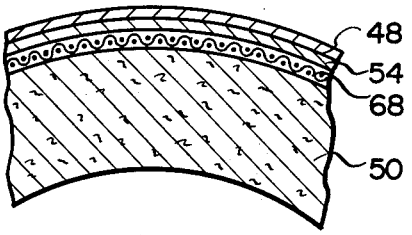

Moreover, instead of the conductive layer 52 made of a synthetic resin containing carbon powder, use may be made of a metal net 68 which is wound directly on the outer periphery of the cylinder 50 as shown in FIG. 7. Parts of the net 68 protrude from the ends of the cylinder 50. Through the portion the net 68 is electrically connected to the ground. If such a net 68 is used instead of the conductor layer 52, a dotted image can be latently formed on the photosensitive layer 48. The net 68 therefore helps to produce a halftone image effectively. The net 68 is preferred to have 500 mesh (JIS) or less.

As described above in detail, the cylinder of the photosensitive drum according to this invention is made of paper or a synthetic resin. The photosensitive drum can therefore light and can be manufactured at a low cost. The supporting mechanism and drive mechanism for the drum can be made small and light. The electronic copying apparatus of this invention can be therefore small and light and manufactured at a low cost.

What is claimed is:

1. A photosensitive drum for a copying apparatus, comprising:

a hollow cylinder including a plastic hollow cylinder base;

a projection secured to the outer periphery of the cylinder base extending parallel to the axis of the cylinder base and having a cross-shaped section; and a rectangular paper sheet rolled about the outer periphery of the cylinder base, the edges of the paper sheet being attached to the projection;

a conductive layer formed on the outer periphery of the hollow cylinder, the conductive layer being fabricated from a synthetic resin containing carbon powder that is partly impregnated into the outer periphery of the hollow cylinder; and a low resistance layer formed on the outer periphery of the conductive layer; and a photosensitive layer formed on the outer periphery of the low resistance layer.

2. In an electronic copying apparatus, a photosensitive drum comprising:

a drum body including a hollow cylinder made of at least one selected from the group consisting of paper and a synthetic resin, a conductive layer formed on the outer periphery of the hollow cylinder, and a low resistance layer formed on the outer peripheral surface of the conductive layer; and a photosensitive layer formed on the outer peripheral surface of the low resistance layer, wherein said hollow cylinder has a hollow cylinder base made of plastics, a projection secured to the outer periphery of the plastic hollow cylinder base, extending parallel to the axis of the plastic hollow cylinder base and having a cross-shaped section, and a rectangular paper sheet rolled about the outer periphery of the plastic hollow cylindrical base, the edges of said paper sheet being attached to the projection.

* * * * *